US007254849B1

(12) United States Patent
Fiebrich et al.

(10) Patent No.: US 7,254,849 B1
(45) Date of Patent: Aug. 14, 2007

(54) SNUG & TUG SWADDLING BLANKET

(75) Inventors: Georgia Gabrielle Fiebrich, Alexandria, VA (US); Catherine Nora Hall, Washington, DC (US)

(73) Assignee: Go Mama Go Designs, LLC, Alexandria, VA (US)

( * ) Notice: Subject to any disclaimer, the term of this patent is extended or adjusted under 35 U.S.C. 154(b) by 0 days.

(21) Appl. No.: 11/404,922

(22) Filed: Apr. 17, 2006

(51) Int. Cl.
*A41B 13/06* (2006.01)

(52) U.S. Cl. ..... 5/482; 5/923; 5/922; 2/69.5

(58) Field of Classification Search ..... 5/482, 5/494, 655, 923, 413 R, 485, 424, 922; 2/69, 2/69.5; D6/603; D2/719
See application file for complete search history.

(56) References Cited

U.S. PATENT DOCUMENTS

| | | | |
|---|---|---|---|
| 218,420 | A | 8/1879 | Baker |
| 965,921 | A | 8/1910 | Mercey |
| 1,373,378 | A | 3/1921 | Backmann |
| 1,583,419 | A | 5/1926 | Perl |
| 1,584,853 | A | 5/1926 | Dem |
| 1,678,125 | A | 7/1928 | Petrescu |
| 1,723,644 | A | 8/1929 | Collingbourne |
| D109,371 | S | 4/1938 | Freidman |
| 2,227,751 | A | 1/1941 | Idelman |
| 2,358,410 | A | 9/1944 | Matthesius |
| 2,538,420 | A | 1/1951 | Junghans |
| 2,657,387 | A | 11/1953 | Ketcham |
| 2,701,885 | A | 2/1955 | Turco |
| 3,034,132 | A | 5/1962 | Landsberger et al. |
| 3,412,407 | A | 11/1968 | Key |
| 3,477,065 | A | 11/1969 | Hoover |
| 3,693,190 | A | 9/1972 | Hickling |
| 3,739,399 | A | 6/1973 | Sheahon |
| 4,125,903 | A | 11/1978 | Farrell |
| 4,172,300 | A | 10/1979 | Miller |
| D269,658 | S | 7/1983 | Bor |
| 4,897,885 | A | 2/1990 | Lunt |
| 4,979,250 | A | 12/1990 | Troncone et al. |
| 5,046,204 | A | 9/1991 | Mohler |
| 5,058,226 | A | 10/1991 | Crosby |
| 5,062,168 | A | 11/1991 | Kocib |
| 5,129,406 | A | 7/1992 | Magnusen et al. |
| 5,243,724 | A | 9/1993 | Barnes |
| 5,611,095 | A | 3/1997 | Schneider |
| 5,722,094 | A | 3/1998 | Ruefer |
| D395,188 | S | 6/1998 | Rush |
| 5,852,827 | A | 12/1998 | Lear |
| D405,635 | S | 2/1999 | Cohen et al. |
| 5,950,261 | A | 9/1999 | Hay et al. |
| 6,009,576 | A | 1/2000 | Gramme et al. |
| D422,775 | S | 4/2000 | Hurr |

(Continued)

*Primary Examiner*—Alexander Grosz

(57) ABSTRACT

A swaddling blanket serves to tightly wrap and enclose a young baby in a sheet of fabric to calm and soothe it. A swaddling blanket is a three-sided blanket that contains a pouch in the middle in which to contain the infant. The second portion of the blanket crosses over the front of the infant's torso, then is placed through a slit in the first portion of the blanket, and secured to the back of the blanket by cooperating hook and loop fasteners. The third portion of the blanket then crosses over the front of the infant's torso and chest, wraps around the entire body of the infant and is secured in the front by additional hook and loop fasteners.

16 Claims, 10 Drawing Sheets

U.S. PATENT DOCUMENTS

| | | | |
|---|---|---|---|
| D423,760 | S | 5/2000 | Sorenson |
| D425,288 | S | 5/2000 | Cohen et al. |
| D428,683 | S | 8/2000 | Davis |
| D448,142 | S | 9/2001 | Callan |
| D448,914 | S | 10/2001 | Caudill |
| 6,321,389 | B1 | 11/2001 | Sankey |
| 6,341,397 | B1 | 1/2002 | Kliegl et al. |
| 6,415,442 | B1 | 7/2002 | Smith |
| 6,640,340 | B2 | 11/2003 | Gibson |
| 6,662,390 | B1 | 12/2003 | Berger |
| 6,817,033 | B2 | 11/2004 | Bailey |
| 6,839,924 | B2 | 1/2005 | Sims |
| D501,350 | S | 2/2005 | Kelly et al. |
| 6,928,674 | B2 | 8/2005 | Blackburn |

SNUG & TUG SWADDLING BLANKET

The following references disclose various infant care devices.

| | | | |
|---|---|---|---|
| 1. 218420 | August 1879 | Baker | 2/69.5, 5/494 |
| 2. 965921 | August 1910 | Mercey | 2/69, 5/413R |
| 3. 1373378 | March 1921 | Backmann | 2/69 |
| 4. 1583419 | May 1926 | Perl | 5/413R |
| 5. 1584853 | May 1926 | Dern | 2/69 |
| 6. 1678125 | July 1928 | Petrescu | 5/413R, 2/69 |
| 7. 1723644 | August 1929 | Collingbourne | 2/69.5 |
| 8. D109371 | April 1938 | Friedman | D2/719 |
| 9. 2227751 | January 1941 | Idelman. | 2/69.5 |
| 10. 2358410 | September 1944 | Matthesius | 2/69.5, 5/413R |
| 11. 2538420 | January 1951 | Junghans | 2/69, 2/69.5, 5/413R |
| 12. 2657387 | November 1953 | Ketcham. | 2/69.5 |
| 13. 2701885 | February 1955 | Turco | 5/494, , 2/69.5 |
| 14. 3034132 | May 1962 | Landsberger et al. | 2/69.5 |
| 15. 3412407 | November 1968 | Key | 2/69.5 |
| 16. 3477065 | November 1969 | Hoover | 2/69.5 |
| 17. 3693190 | September 1972 | Hickling | 2/69.5 |
| 18. 3739399 | June 1973 | Sheahon | 2/69.5 |
| 19. 4125903 | November 1978 | Farrell | 2/69.5 |
| 20. 4172300 | October 1979 | Miller | 5/424 |
| 21. D269658 | July 1983 | Bor | D2/719 |
| 22. 4897885 | February 1990 | Lunt. | 2/69.5 |
| 23. 4979250 | December 1990 | Troncone et al. | 5/494 |
| 24. 5046204 | September 1991 | Mohler | 5/413 R |
| 25. 5058226 | October 1991 | Crosby | 5/494 |
| 26. 5062168 | November 1991 | Kocib | 5/413R |
| 27. 5129406 | July 1992 | Magnusen et al. | 128/873 |
| 28. 5243724 | September 1993 | Barnes | 5/482 |
| 29. 5611095 | March 1997 | Schneider | 5/482 |
| 30. 5722094 | March 1998 | Ruefer | 2/69.5 |
| 31. D395188 | June 1998 | Rush. | D6/603 |
| 32. 5852827 | December 1998 | Lear | 2/69.5 |
| 33. D405635 | February 1999 | Cohen et al. | D6/603 |
| 34. 5950261 | September 1999 | Hay et al. | 5/482 |
| 35. 6009576 | January 2000 | Gramme et al. | 5/413R |
| 36. D422775 | April 2000 | Hurr | D2/719 |
| 37. D423760 | May 2000 | Sorenson | D2/719 |
| 38. D425288 | May 2000 | Cohen et al. | D6/603 |
| 39. D428683 | August 2000 | Davis | D2/719 |
| 40. D448142 | September 2001 | Callan | D2/719 |
| 41. D448914 | October 2001 | Caudill | D2/719 |
| 42. 6321389 | November 2001 | Sankey | 2/69.5 |
| 43. 6341397 | January 2002 | Kliegl et al. | 5/482, 2/69.5 |
| 44. 6415442 | July 2002 | Smith | 2/69.5 |
| 45. 6640340 | November 2003 | Gibson | 2/69.5 |
| 46. 6662390 | December 2003 | Berger | 5/486 |
| 47. 6817033 | November 2004 | Bailey | 2/69.5 |
| 48. 6928674 | November 2004 | Blackburn | 5/482, 2/69.5 |
| 49. 6839924 | January 2005 | Sims | 5/494, 2/69.5 |
| 50. D501350 | February 2005 | Kelly et al. | D6/603 |

OTHER REFERENCES

1. Swaddle Me—From Kiddopotamus
2. Cradle Me's™ from Baby Boo's™
3. Swaddleaze from 2 Virtues
4. The Amazing Miracle Blanket from AMB Enterprises
5. The Ultimate Swaddling Blanket™ from Swaddle Designs
6. Loving Baby™ Swaddle Blanket by Loving Baby Inc
7. Cuddle Bug Cloverleaf Blanket™ by Cuddle Bug
8. First Years Swaddling Blanket from The First Years Inc.
9. Simple Swaddle.™ blankets by Simple Swaddle
10. Natural Swaddle™ Blanket by Beyond Baby Basics

STATEMENT REGARDING FEDERALLY SPONSORED RESEARCH OR DEVELOPMENT

Non-Applicable

REFERENCE TO SEQUENCE LISTING, A TABLE, OR A COMPUTER PROGRAM LISTING COMPACT DISK APPENDIX

Non-Applicable

BACKGROUND OF INVENTION

This invention relates to the field of blankets for wrapping and soothing babies, often referred to as swaddling. Swaddling is a practiced custom to soothe and pacify babies. Ensuring that a baby remains tightly enclosed is key to maintaining the baby's state of calmness. Typically, conventional four-sided receiving blankets have often been used to swaddle a baby. While such conventional blankets are often useful tools for swaddling newborns, use of such conventional blankets becomes increasingly difficult to ensure the tightness of a swaddled baby as the baby grows in size.

Other swaddling blankets that currently exist strive to safely and tightly contain the baby; however, many designs fall short of ensuring that the baby remains tightly swaddled. Often, babies are able to push or kick their arms out of the blanket, thus rendering the design and function of such blankets useless.

BRIEF SUMMARY OF THE INVENTION

The present invention addresses the problems and disadvantages of other conventional and known swaddling blankets by providing a blanket that precludes the swaddled baby from loosening the inventive blanket and releasing the swaddled baby's arms and/or legs.

Preferred embodiments of the present invention comprise a triangular shaped blanket that includes a pouch formed in a first portion of the blanket, which is located in the approximate center of the blanket. The pouch is sized to receive and contain the baby. The baby is placed in the pouch with its neck and head resting above the upper edge of the blanket. The pouch, of which the depth allows the blanket to grow with the baby, should extend up to the baby's upper torso. Preferred embodiments of the present invention further comprise a second portion of the blanket, which during use of the present invention is crossed over the front of the baby's upper torso, placed through a slit disposed on a first portion of the blanket, and then secured to the back of the blanket by cooperating hook and loop fasteners. Preferred embodiments of the present invention further include a third portion of the blanket, which is longer than either the first or second portions, and is adapted to cross over the front of the baby's torso and chest, wrapping around the entire body of the baby. The third portion then securely attached to the front of the blanket by additional hook and loop fasteners. The placement of both loop fasteners also allows the blanket to grow with the baby and offer a longer use of the blanket. The present invention provides a unique and necessary series of barriers that prevent a baby from releasing its arms and/or legs and likely waking itself.

A preferred embodiment of the present invention constructs the present invention from a material that keeps the baby warm, but permits "perspiration" to breathe. Moreover, the preferred embodiment employs fabrics, which are machine washable. Cotton knit fabrics and cotton flannels are preferred, but other fabrics may be used. Moreover, other embodiments may include guards or protective sheaths covering the hook components found on the first and second portions so as to prevent the unintended attraction to other garments when washing and drying the blanket. These guards are formed by providing additional loop fasteners to cover the hook components found on both of the second and third portions. These additional components of loop also ensure that the hook fasteners maintain their integrity and withstand long-term use of the blanket.

An ideally designed swaddling blanket would be easy to use, avoid any safety hazards, be made of a soft, but not excessively warm material, and keep a baby tightly bundled so that the swaddled baby is unable to release its arms and/or legs.

DETAILED DESCRIPTION OF THE INVENTION

Figure 1:
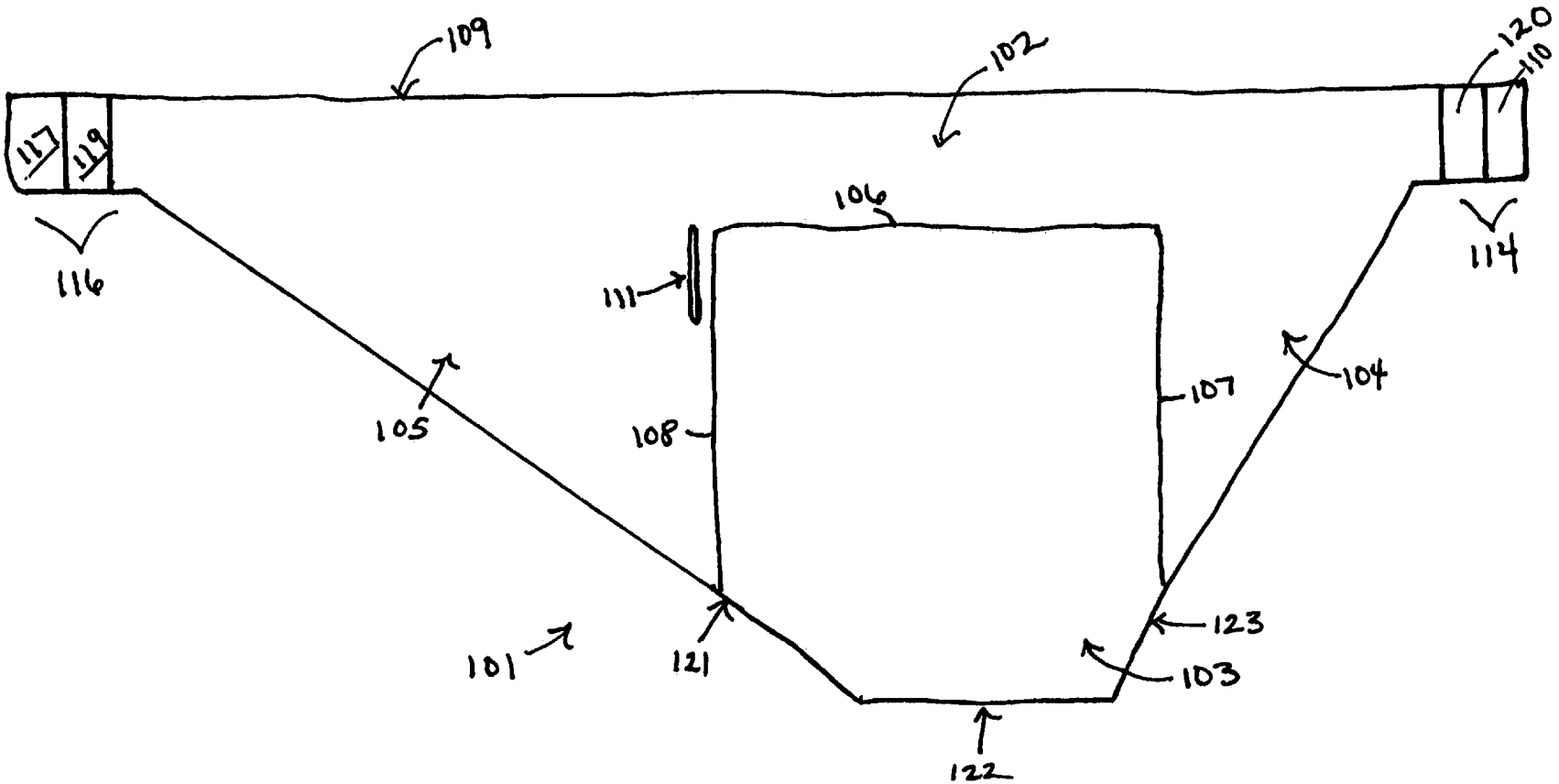
FIG. 1 is an illustrative view of the inner surface of the preferred embodiment of the present invention.

A preferred embodiment of the present invention is shown in FIG. 1, a swaddling blanket 101 includes a first portion 102, a second portion 104 and a third portion 105. A pouch 103 is disposed on the inner surface of first portion 102. The pouch 103, which is sized to receive and contain an infant, is defined by a horizontal open side 106 of the pouch 103 along the top edge, with an attached vertical side 107 along the right edge and an attached vertical side 108 along the left edge, in addition to a center bottom edge 122 and an adjoining bottom left edge 121 and an adjoining bottom right edge 123. The outer dimension of the blanket 101 forms a generally triangular shape, although there is a total of eight distinct sides to the outer edge, and the corners of the two side sections are tapered. The blanket 101 also includes a hemmed edge 109 about its outer perimeter.

The second portion 104 has a tapered portion 114. The tapered portion 114 of second portion 104 has hook and loop fasteners 110 and 120 respectively disposed thereon the inner surface. The third portion 105 has a tapered portion 116. The tapered portion 116 of second portion 105 having hook and loop fasteners 117 and 119 respectively disposed thereon the inner surface.

A reinforced slit 111 is disposed adjacent to the pouch 103 on either the second or third portions 104, 105. In FIG. 1, the reinforced slit 111 is shown to be preferably a vertical slit disposed adjacent to the pouch 103 on third portion 105. However, it is noted that reinforced slit 111 may be a horizontal slit and may be located on either second or third portion 104, 105.

Figure 2:
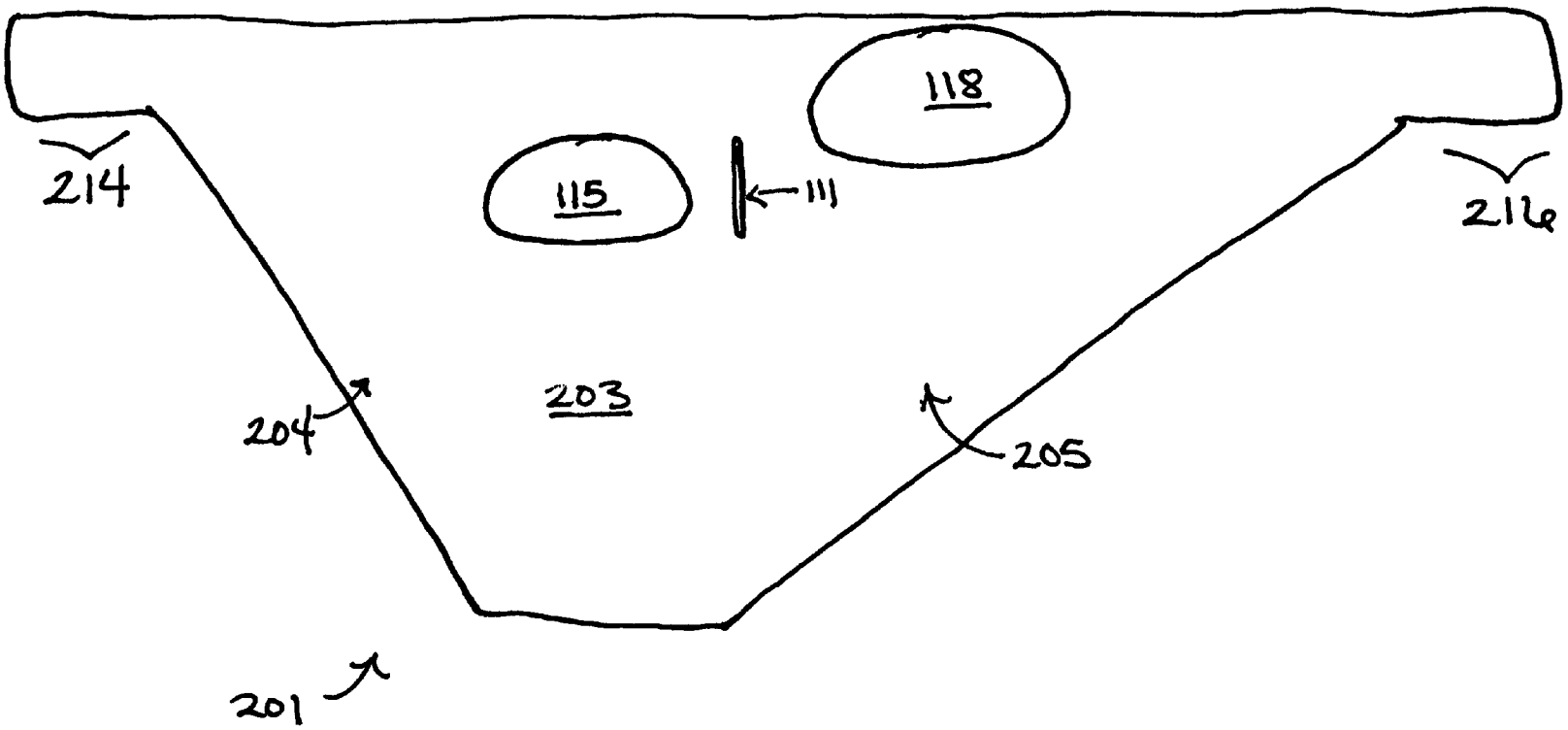
FIG. 2 is an illustrative view of the outer surface of the preferred embodiment of the present invention.

An outer surface view of the preferred embodiment of the present invention is shown in FIG. 2, the outer surface 201 of swaddling blanket 101 includes an outer surface side 203 of first portion 102, an outer surface side 204 of second portion 104 and an outer surface side 205 of third portion 105. FIG. 2 also illustrates the outer surface side 214 of the second portion tapered end 114 and the outer surface side 216 of the third portion tapered end 116. Loop fastener 115 is located on the outer surface 203 of the first portion 102 of the blanket and adheres to hook fasteners 110 located on second portion tapered end 114. Loop fastener 118 is located on the upper outer surface side 205 of third portion 105 and adheres to hook fasteners 117 located on third portion tapered end 116. Moreover, FIG. 2 shows reinforced slit 111 which provides a transit from the inner surface to the outer surface.

Figure 3A:
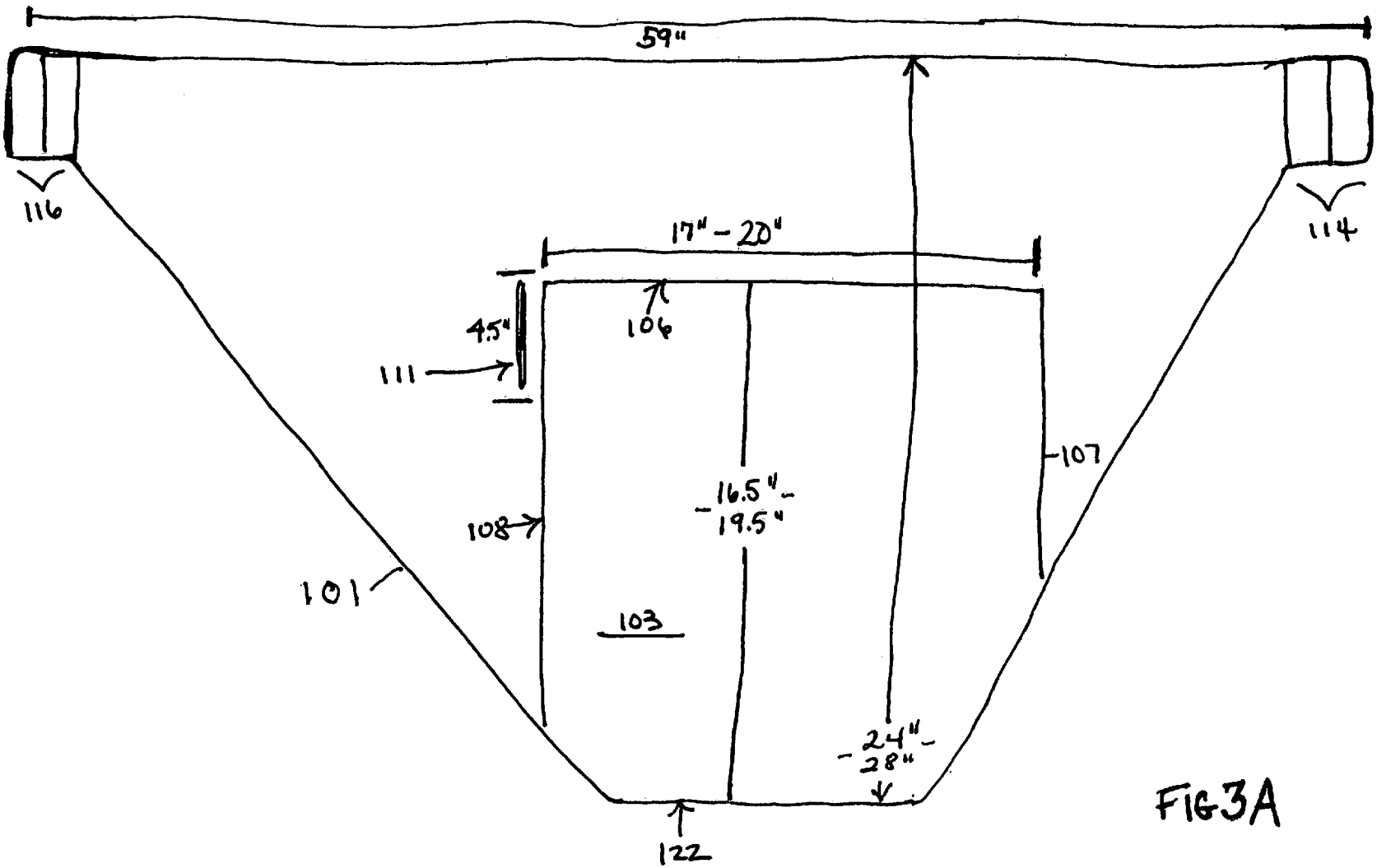
FIGS. 3*a-b* illustratively depicts certain measurements of components of the preferred embodiment of the invention.

FIG. 3A illustrates some preferable dimensions of the blanket 101. For example, blanket 101 measures preferably between about 24" to 28" in overall vertical length and 59" in overall horizontal width. The pouch section 103 of blanket 101 measures 16.5" to 19.5" in overall vertical length and 17" to 20" in overall horizontal width. However, such sizes and dimensions may vary in accordance with the particular size of an infant or toddler to be swaddled. Reinforced slit 111 is shown to preferably measure 4.5" inches.

Figure 3B:
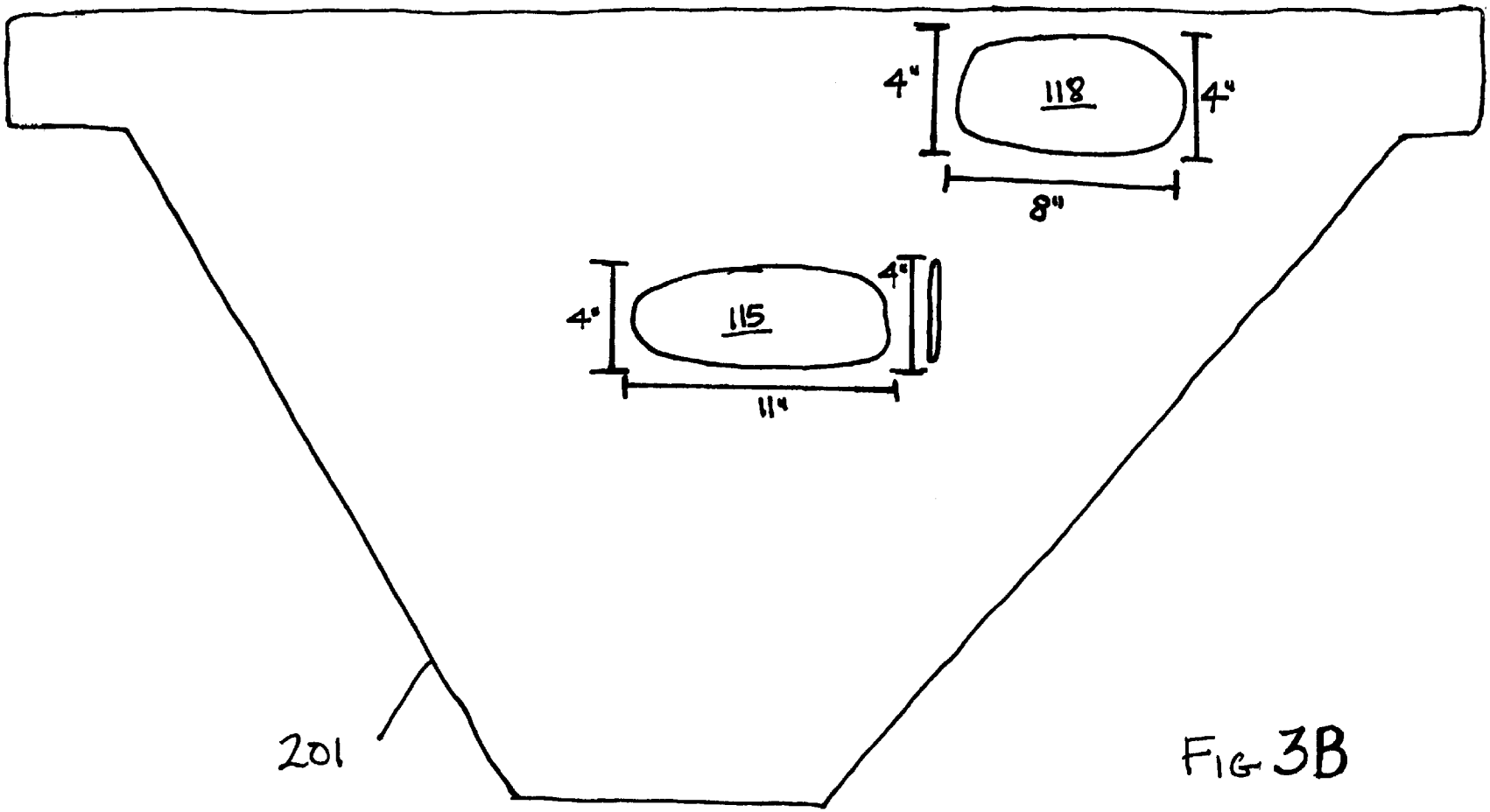

FIG. 3B illustrates preferable dimensions of the loop fasteners disposed on the outer surface of the blanket 101. As shown in FIG. 3B, loop fastener 115 preferably measures 11" in width and 4" in height. This allows for an adjustable position for securing hook fastener 110. By providing an adjustable position for securing hook fastener 110, the preferred embodiment of the present invention allows for a full range of infant sizes that can be accommodated. In addition, as shown in FIG. 3B, loop fastener 118 preferably measures 8" in width and 4" in height. This also allows for an adjustable position for securing hook fastener 117. By providing an adjustable position for securing hook fastener 117, the preferred embodiment of the present invention allows for a full range of infant sizes that can be accommodated.

The blanket 101 is preferably made with a soft, stretchable fabric, such as knit cotton. Preferably, blanket 101 would be made of 100% cotton, but may also contain small amounts of polyester or lycra to allow for stretching. The pouch 103 of blanket 101 is preferably made with a soft cotton flannel. This provides adequate "breathing" of the fabric to prevent overheating of the infant.

Figure 4A:
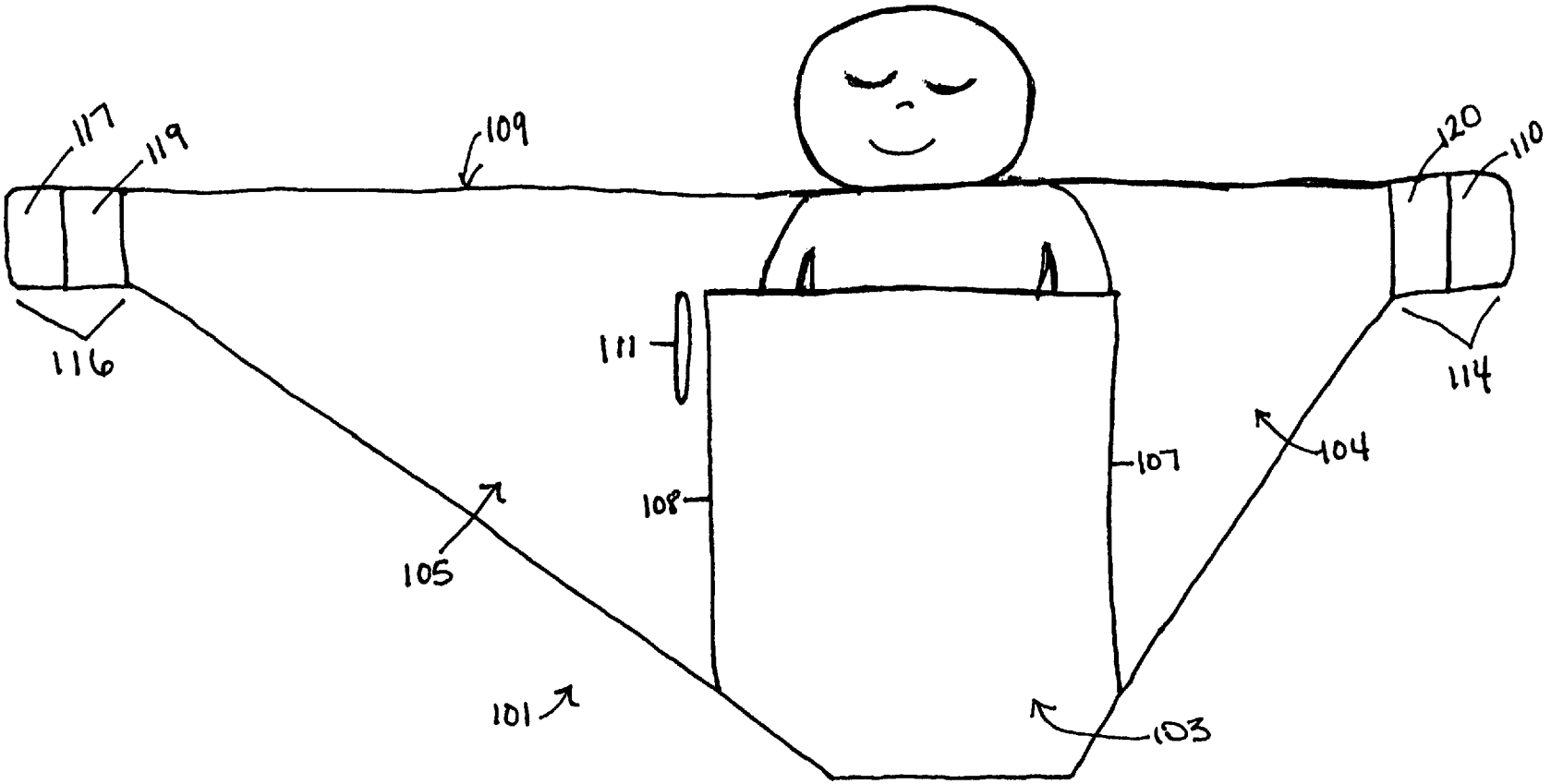
FIGS. 4*a* to 4*e* illustratively depict the operation of the preferred embodiment of the present invention.
Figure 4B:
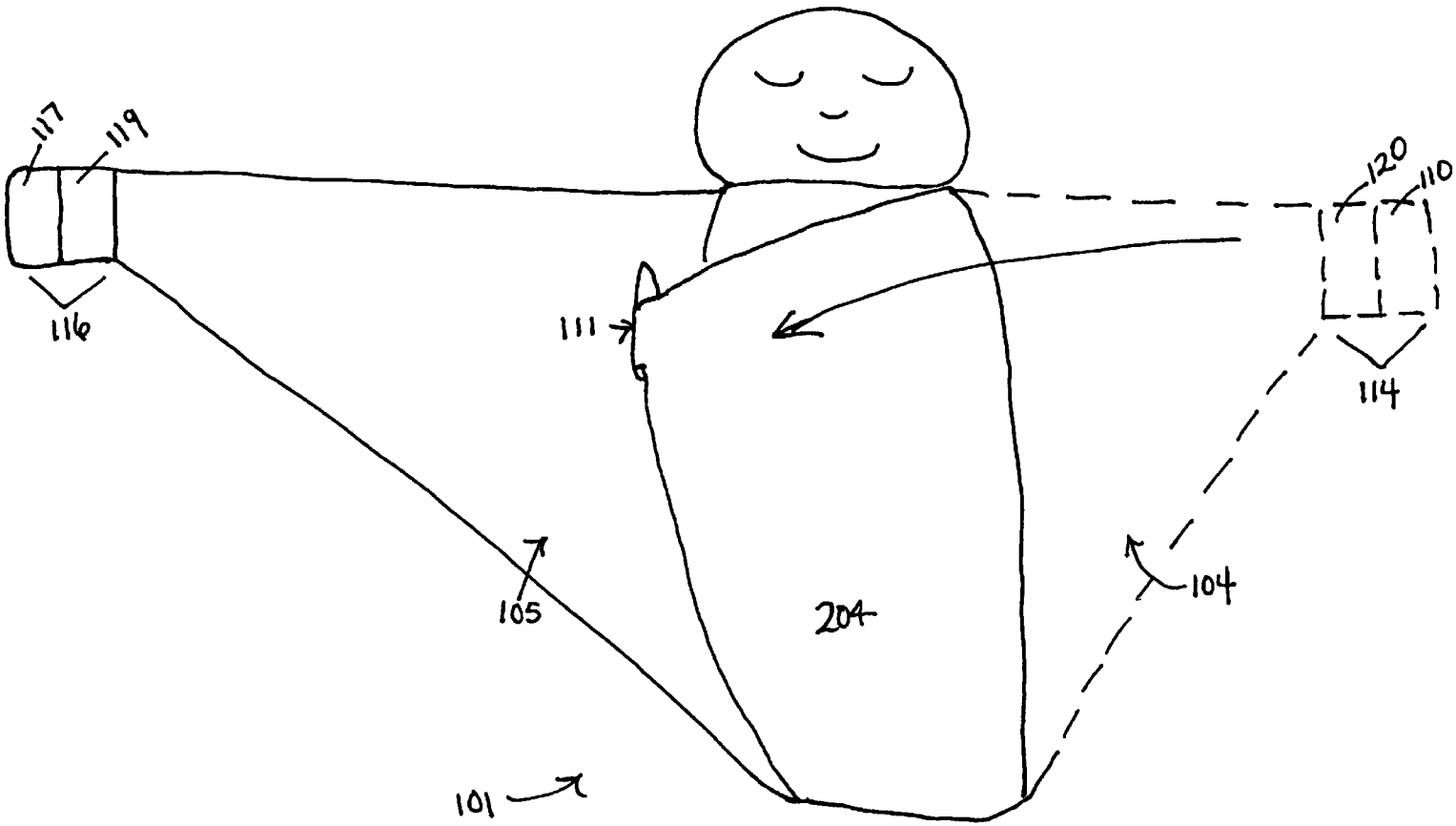

FIGS. 4A-4E illustrate the method of using the present invention. An infant is placed into the pouch 103, as shown in FIG. 4A. As can be seen in FIG. 4A, by sizing the pouch to extend at least to the infant's upper torso, the infant's arms and legs can be secured and prevented from kicking or flailing free from the pouch. Once the infant is placed in the pouch 103, the second portion 104 is folded over the front of a baby, and the tapered end 114 is pulled through reinforced slit 111, and the outer surface side of the second portion 204 becomes front facing, this is demonstrated in FIG. 4B. Slit 111 is similar to a large button hole and is preferably about 4" in length and located on the left side of pouch 103 and is located no higher than the horizontal edge 116 of pouch 103. The combination of a deep pouch, a slit, and properly sized and placed hook and loop fasteners provides a unique and necessary series of barriers that prevent a baby from releasing its arms and/or legs and likely waking itself.

Figure 4C:
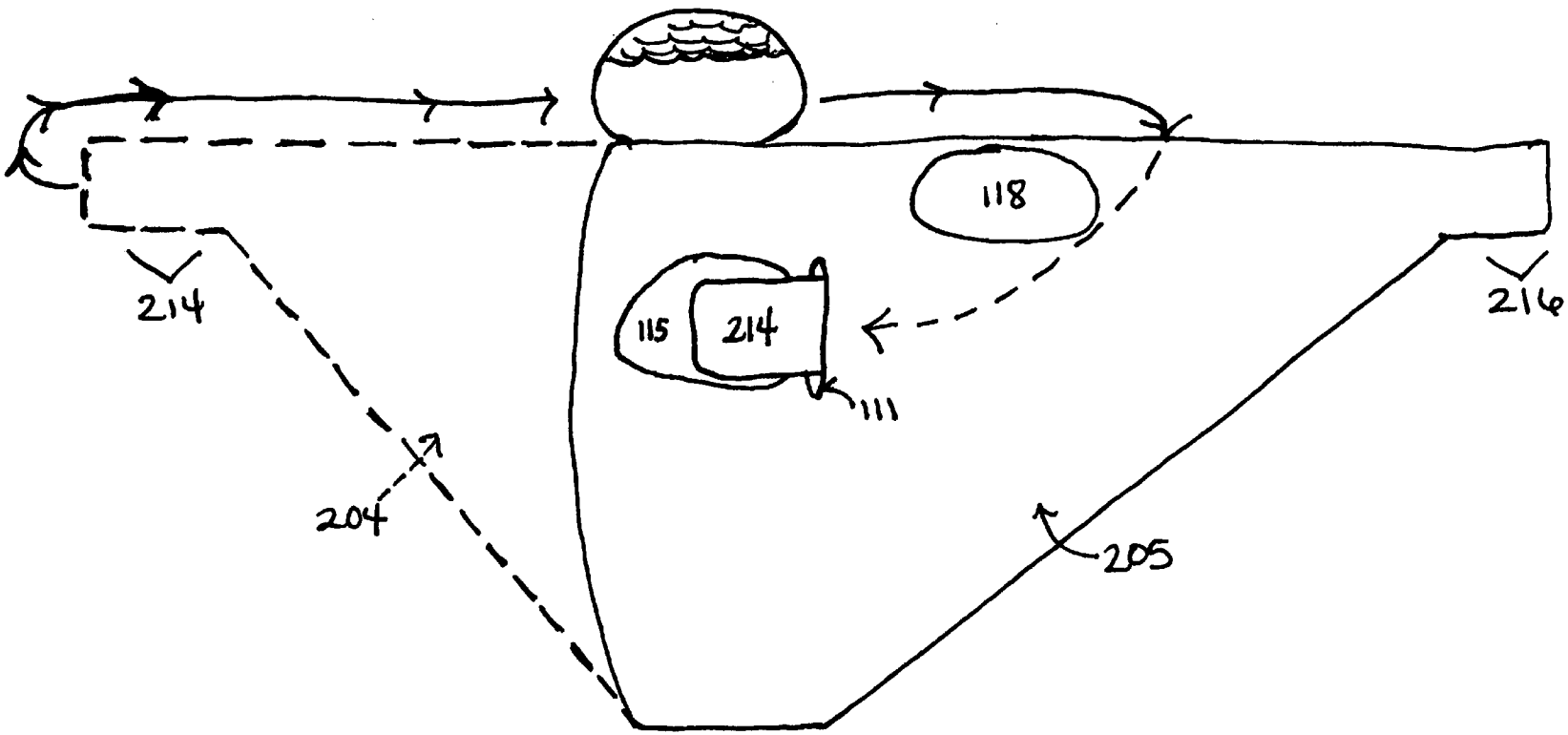

FIG. 4C displays the outer surface side 201 of the preferred invention, the second portion tapered end 114, which has been pulled through slit 111, houses a hook fastener 110, and now adheres to loop fastener(s) 115, whose number and shape may vary, located on the outer surface side of blanket 101 (FIG. 3B). The loop fastener 115 preferably covers an area of space about 4" wide and preferably about 11" long and is placed parallel to slit 111 (FIG. 3B). The hook and loop fasteners are each sized and positioned to provide sufficient fastening strength so as to prevent loosening the baby when fastened as well as adjustability to provide room for infant growth.

Figure 4D:
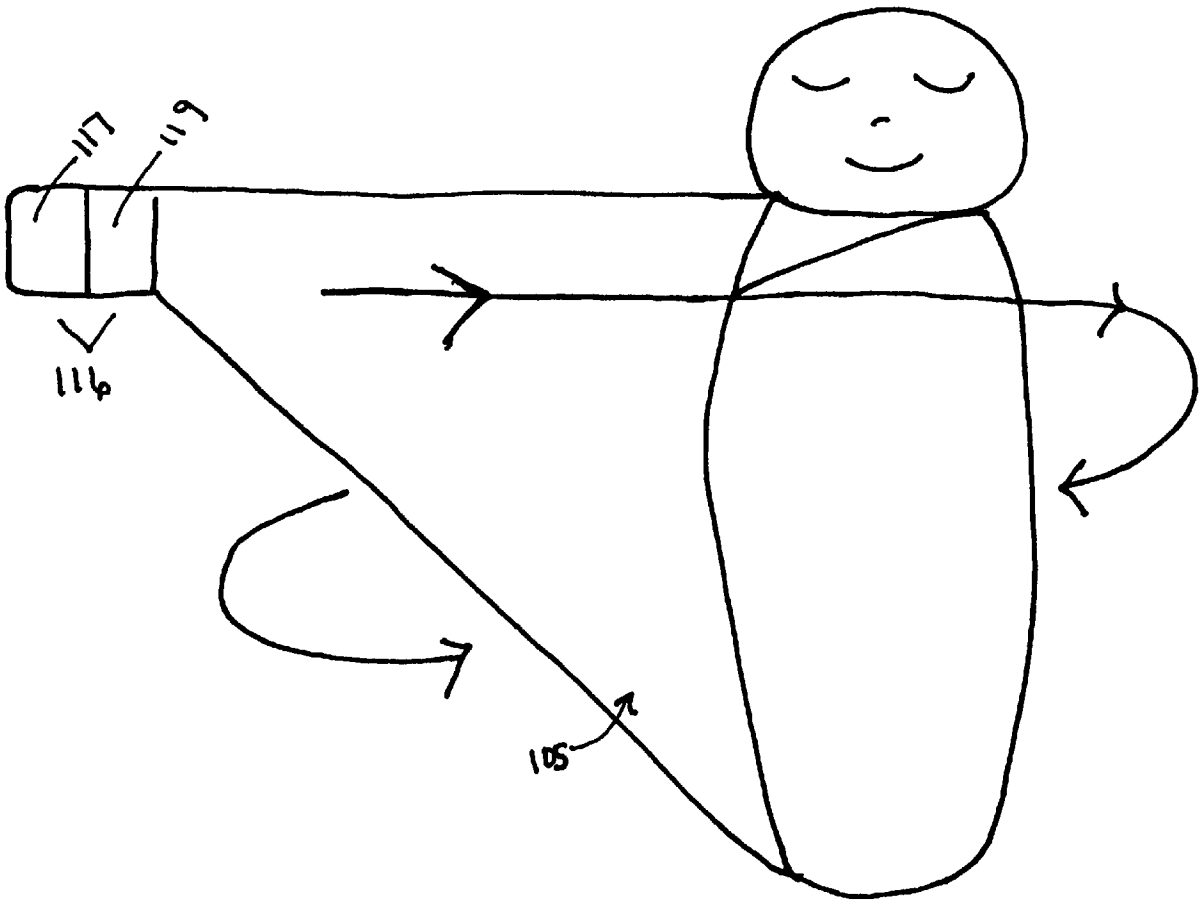

As shown in FIG. 4D, the third portion 105 is wrapped first across the front of the infant and then wrapped around the entire body. The third portion tapered end 116, which houses left hook fastener 117, is pulled tightly around and across the front of the infant and adheres to a second loop fastener 118, whose number and shape may vary, and preferably covers an area of space about 4" wide and about 8" long (FIG. 3B). The hook and loop fasteners are each sized and positioned to provide sufficient fastening strength so as to prevent loosening by the infant when fastened as well as adjustability to provide room for growth.

Figure 4E:
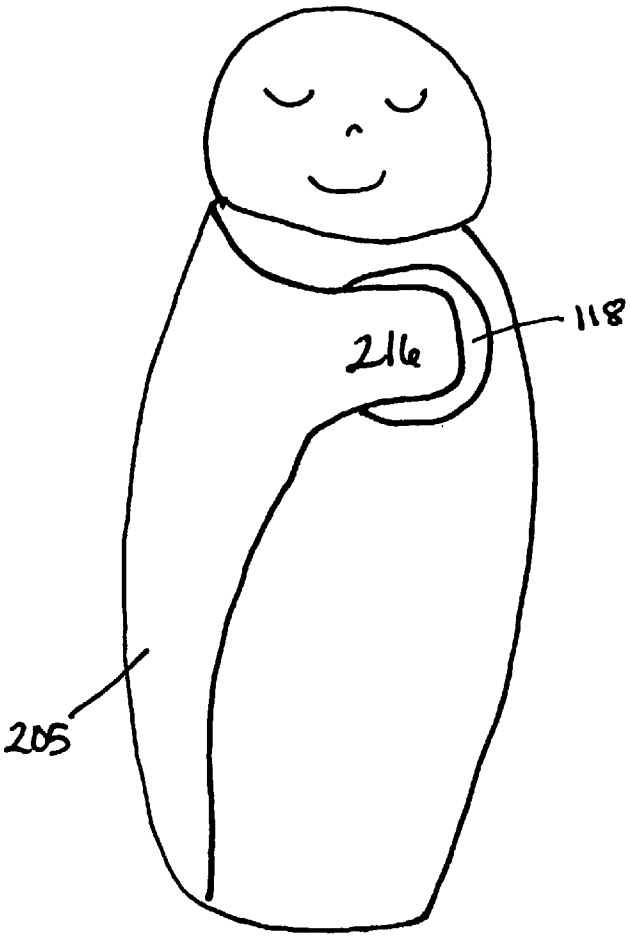

FIG. 4E displays the final view of the infant swaddled in the preferred embodiment, where it remains securely, safely, and warmly swaddled.

To remove the infant, the steps of FIGS. 4A to 4E are reversed as follows. The hook and loop fastener portions 117 and 118 are separated and the third portion 105 is unwrapped from around the infant. Next, the hook and loop fastener portions 110 and 115 are separated and the tapered edge 114 of second portion 104 is pulled back through reinforced slit 111. The infant can then be pulled from pouch 103.

In an alternative embodiment, the swaddling blanket of the present invention may be employed to swaddle an infant without the use of the pouch 103. By placing the infant in the approximate center of the blanket not within the pouch 103, the hook and loop fasteners found on tapered edge portions 114 and 116 along with the reinforced slit 111, may be used to quickly and securely swaddle an infant.

Figure 5:
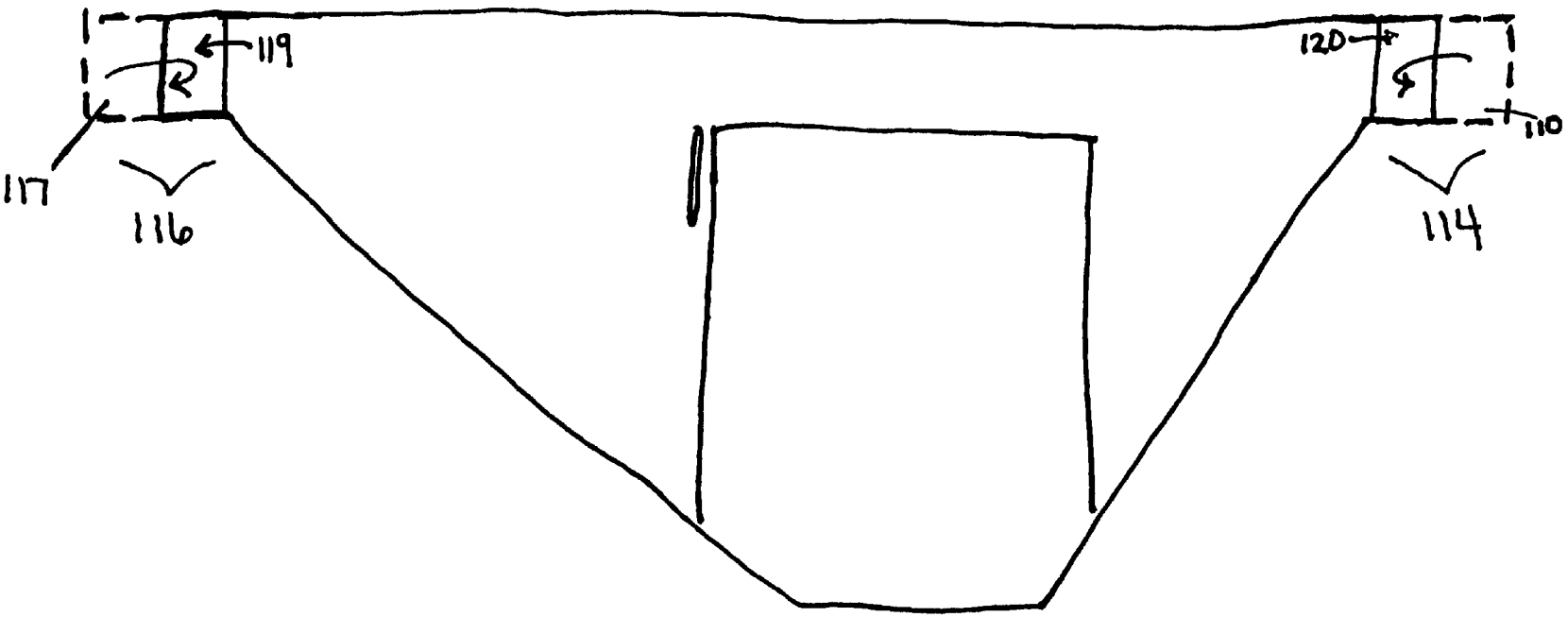
FIG. 5 illustrates the guard components of one of the embodiments of the present invention.

Second and third portion tapered ends 114 and 116 also contain loop fastener components 119 and 120 (FIG. 1), to which hook fasteners 110 and 117 can adhere by simply folding them over, see FIG. 5. By folding over hook tabs 110 and 117 to attach to loop fasteners 119 and 120, the user of this invention can avoid attracting other fabrics to the hook fasteners when washing or drying the preferred embodiment. It also serves to uphold the integrity and long-term use of the hook fasteners 110 and 117 located on blanket 101.

We claim:

1. An article for swaddling an infant, said article comprising:

a sheet of flexible material having an inner surface for receiving the infant and an outer surface, said sheet of flexible material having in combination:

a first portion wherein a pouch is secured to an inner surface, said pouch being sized to contain the infant up to at least the infant's upper torso;

a reinforced slit disposed adjacent to a first side of the pouch to allow passage through the inner surface to the outer surface;

a second portion having cooperating fasteners and adapted to wrap around the infant contained in the pouch and arranged to transit through the reinforced slit and secure to the outer surface of the sheet of flexible material; and a third potion adapted to wrap over and around the infant and is secure to the outer surface of the sheet of flexible material, the second and third portions being tapered to end portions having a horizontal width of about 4 inches, each end portion having a hook fastener component and a loop fastener component disposed thereon, with the hook fastener components being positioned adjacent the loop fastener components.

2. The article of claim 1 wherein the sheet of flexible material is generally triangularly shaped.

3. The article of claim 1 wherein said slit is a vertical slit.

4. The article of claim 1 wherein an overall distance in a vertical direction is between about 23" and 28".

5. The article of claim 1 wherein an overall distance in a horizontal direction is between about 53" and 59".

6. The article of claim 1 wherein the pouch is disposed approximately 16" to 19" above a bottom edge of the article.

7. The article of claim 1 wherein the distance in a vertical direction of the pouch is between about 17" to 20".

8. The article of claim 1 wherein the hook fastener components on each tapered end portion are about 4" in vertical length.

9. The article of claim 1 wherein the hook fastener components on each tapered end portion are about 2" in horizontal width.

10. The article of claim 1 wherein the loop fastener components on each tapered end portion are about 4" in vertical length.

11. The article of claim 1 wherein the loop fastener components on each tapered end portion are about 2" in horizontal width.

12. The article of claim 1 further comprising outer surface loop fasteners disposed on the outer surface of the first portion to secure the hook fastener components disposed on the tapered end portion of the second portion.

13. The article of claim 12 wherein the outer surface loop fastener components disposed on the outer surface of the first portion are sized to provide ample area to secure the hook fastener components disposed on the tapered end portion of the second portion.

14. The article of claim 1 further comprising outer surface loop fastener components disposed on the outer surface of the third portion to secure the hook fastener components disposed on the tapered end of the third portion after the third portion is wrapped over and around the infant.

15. The article of claim 1 wherein the sheet of flexible material is selected from the group comprising: cotton, cotton knit, or cotton interlock.

16. The article of claim 1, wherein said pouch is constructed of cotton flannel.

* * * * *